US008808036B2

(12) United States Patent
Xu

(10) Patent No.: US 8,808,036 B2
(45) Date of Patent: Aug. 19, 2014

(54) ELECTRICAL CONNECTOR HAVING CIRCUIT DEFINING A NUMBER OF DIFFERENTIAL CHANNELS

(71) Applicant: Hon Hai Precision Industry Co., Ltd., New Taipei (TW)

(72) Inventor: Yong-Chun Xu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 10 days.

(21) Appl. No.: 13/630,159

(22) Filed: Sep. 28, 2012

(65) Prior Publication Data

US 2013/0078830 A1 Mar. 28, 2013

(30) Foreign Application Priority Data

Sep. 28, 2011 (CN) ..... 2011 1 0296922

(51) Int. Cl.
*H01R 24/00* (2011.01)

(52) U.S. Cl.
USPC ..... 439/676; 439/620.09; 439/620.17; 439/81

(58) Field of Classification Search
USPC ..... 439/81, 620.07, 620.09, 620.17, 439/620.19, 620.24
See application file for complete search history.

(56) References Cited

U.S. PATENT DOCUMENTS 5,587,884 A * 12/1996 Raman ..... 439/620.17
5,687,233 A 11/1997 Loudermilk et al.
5,971,813 A 10/1999 Kunz et al.
6,089,923 A 7/2000 Phommachanh
6,097,262 A 8/2000 Combellack
6,302,741 B1 10/2001 Fasold et al.
7,153,163 B2 12/2006 Lewis et al.
7,658,648 B2 * 2/2010 Aekins ..... 439/620.11
8,353,723 B2 * 1/2013 Heckmann ..... 439/620.11
2009/0243757 A1 * 10/2009 Xu et al. ..... 439/620.05
2010/0317230 A1 * 12/2010 Larsen et al. ..... 439/620.22

FOREIGN PATENT DOCUMENTS

CN 201266942 Y 7/2009

* cited by examiner

*Primary Examiner* — Briggitte R Hammond

(74) *Attorney, Agent, or Firm* — Ming Chieh Chang; Wei Te Chung

(57) ABSTRACT

An electrical connector has a circuit comprising a first side; a second side; a first differential channel located between the first side and the second side and comprising a first positive differential trace and a first negative differential trace for transmitting first differential signal; a second differential channel located between the first side and the second side comprising a second positive differential trace and a second negative differential trace for transmitting second differential signal; and a plurality of mating contacts connected to the second side and comprising a first contact connected to the first positive differential trace, a second contact connected to the first negative differential trace, a third contact connected to the second positive differential trace and a sixth contact connected to the second negative differential trace, the first contact, the second contact, the third second and the sixth contact are arranged one by one.

16 Claims, 4 Drawing Sheets

ELECTRICAL CONNECTOR HAVING CIRCUIT DEFINING A NUMBER OF DIFFERENTIAL CHANNELS

BACKGROUND OF THE INVENTION

1. Field of the Invention

The present invention relates to an electrical connector, and more particularly to an electrical connector having circuit defining a number of differential channels.

2. Description of Related Arts

U.S. Pat. No. 6,302,741 issued on Oct. 16, 2001, discloses a modular jack connector having a plurality of contacts 1 to 8 arranged in a housing. The contacts 1 and 2 are connected to two ends of one filtering device CC1. The contacts 3 and 6 are connected to two ends of another filtering device CC2. The contacts 4 and 5 are located between the contact 3 and the contact 6, and connected to a resistor. A distance between the contact 3 and the contact 6 is greater than a distance between the contact 1 and the contact 2.

CN Patent No. 201266942Y issued on Jul. 1, 2009, discloses a circuit for providing power or signal to a number of mating contacts in an electrical connector. The circuit includes a first side occupied by a circuit board, a second side opposite to the first side and a plurality of transmission channels located between the first side and the second side. A number of mating contacts are arranged side by side to connect to the second side in the electrical connector. The mating contacts include a first contact, a second contact adjacent to the first contact using together for transmitting a first differential signal through a first transmission channel, a third contact and a sixth contact using together for transmitting a second differential signal through a second transmission channel. A fourth contact and a fifth contact are located between the third contact and the sixth contact using together for transmitting a third differential signal through a third transmission channel. Because a distance between the third contact and the sixth contact being greater than a distance between the first contact and the second contact, the impedances of the two transmission channels do not match each other. Due to this limitation of the electrical connector, system testing of the electrical connector will show a loss of transmission signal.

As discussed above, an improved electrical connector overcoming the shortages of existing technology is needed.

SUMMARY OF THE INVENTION

An object of the present invention is to provide an electrical connector having improved impedance matching of differential channels.

To achieve the above-mentioned object, an electrical connector has a circuit comprising a first side; a second side; a first differential channel located between the first side and the second side and comprising a first positive differential trace and a first negative differential trace for transmitting first differential signal; a second differential channel located between the first side and the second side comprising a second positive differential trace and a second negative differential trace for transmitting second differential signal; and a plurality of mating contacts connected to the second side and comprising a first contact connected to the first positive differential trace, a second contact connected to the first negative differential trace, a third contact connected to the second positive differential trace and a sixth contact connected to the second negative differential trace, the first contact, the second contact, the third second and the sixth contact are arranged one by one. A distance between the third contact and the sixth contact is greater than a distance between the first contact and the second contact. A capacitor is connected the second positive differential trace to the second negative differential trace for matching impedance of the first differential channel.

Other objects, features and advantages of the invention will be apparent from the following detailed description taken in connection with the accompanying drawings.

DETAILED DESCRIPTION OF THE PREFERRED EMBODIMENT

Figure 1:
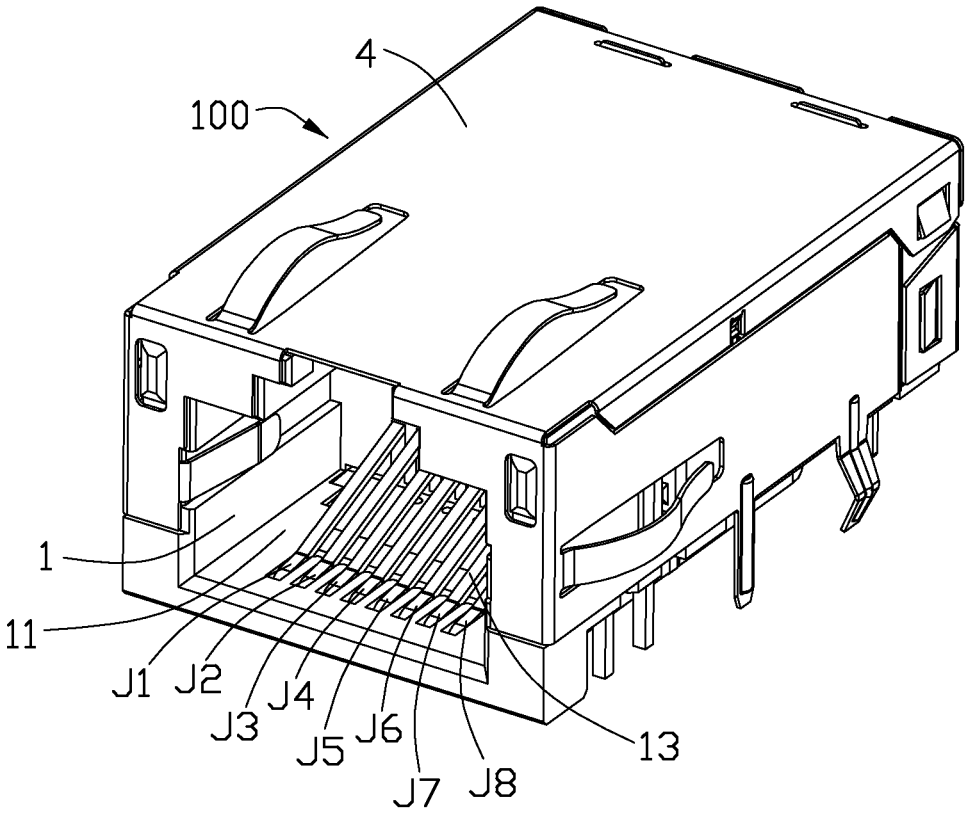
FIG. 1 is a perspective view of an electrical connector in accordance with the present invention.

Reference will now be made in detail to a preferred embodiment of the present invention.

Referring to FIGS. 1 to 4, an electrical connector 100 being mounted on an external circuit board (not shown) in accordance with the present invention comprises a housing 1, a number of mating contacts 13 (J1, J2, J3, J4, J5, J6, J7, J8) received in the housing 1, and a shell 4 enclosing the housing 1. The housing 1 defines a mating cavity 11 for mating to a complementary connector (not shown). The mating contacts 13 are received in the mating cavity 11. The electrical connector 100 is a RJ45 type connector.

Figure 2:
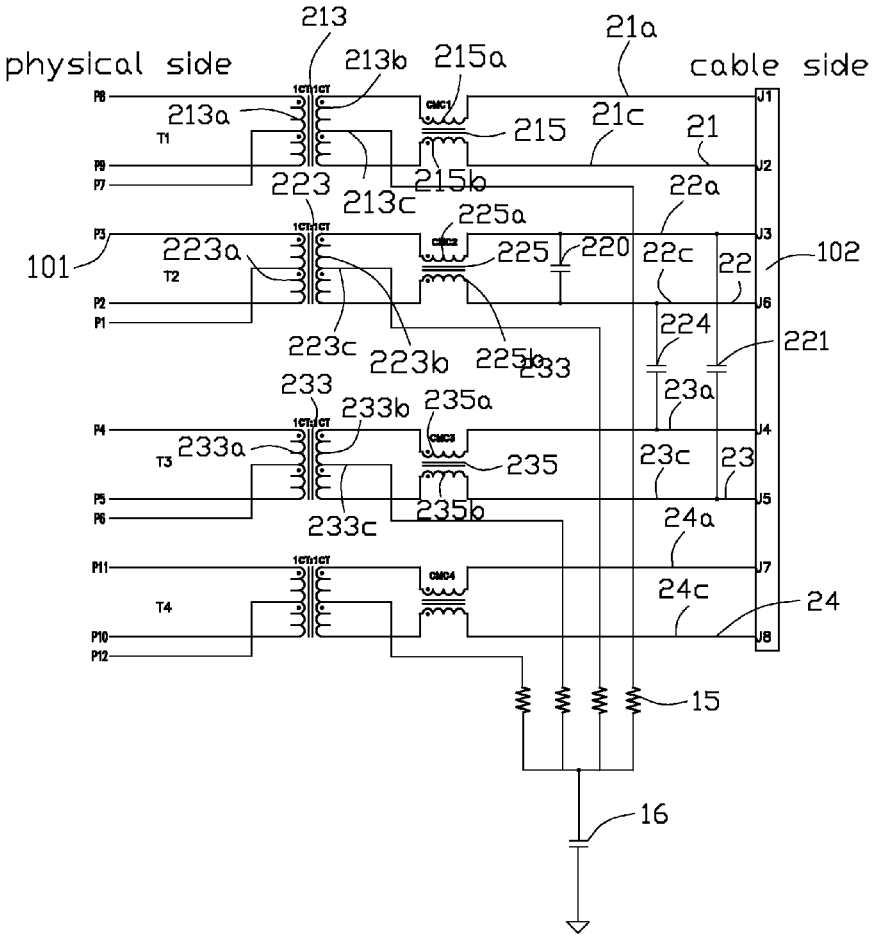
FIG. 2 is a schematic diagram of a circuit of the electrical connector as shown in FIG. 1.

FIG. 2 is configured as a circuit connecting the mating connects 13 to an internal circuit board (not shown) mounted onto the housing 1. The mating contacts 13 have eight contacts which are composed of a first to an eighth contacts (J1 to J8) located on or connected to a cable side 101 in FIG. 2 in this embodiment. The circuit comprises a first side 101 (physical side) for receiving a power and/or signal from the internal circuit board, a second side 102 (cable side) opposite to the first side 101, and a plurality of differential channels connecting the first side 101 to the second side 102. The second side 102, connected to the first to eighth contacts (J1 to J8) is for complying electrical transmission.

The differential channel comprises a first differential channel 21, a second differential channel 22, a third differential channel 23 and a fourth differential channel 24 arranged in sequence. The first differential channel 21 comprises a first positive differential trace 21*a* connected to the first contact J1 and a first negative differential trace 21*c* connected to the second contact J2 for together transmitting first signal. That is, both the first contact J1 and the second contact J2 form a pair of first differential signal contacts connected to the first differential channel 21. The second differential channel 22 defines a second positive differential trace 22*a* connected to the third contact J3 and a second negative differential trace 22*c* connected to the sixth contact J6 for together transmitting second signal. That is, both the third contact J3 and the sixth contact J6 form a pair of second differential signal contacts connected to the second differential channel 22. The third differential channel 23 comprises a third positive differential trace 23*a* connected to the fourth contact J4 and a third negative differential trace 23*c* connected to the fifth contact J5 for together transmitting third signal. That is, both the fourth contact J4 and the fifth contact J5 form a pair of third differential signal contacts connected to the third differential channel 23. The fourth differential channel 24 comprises a fourth positive differential trace 24*a* connected to the seventh contact J7 and a fourth negative differential trace 24*c* connected to the eighth contact J8 for together transmitting fourth signal. That is, both the seventh contact J7 and the eighth contact J8 form a pair of fourth differential signal contacts connected to the fourth differential channel 24. The distance between the third contact J3 and the sixth contact J6 is greater than the distance between the first contact J1 and the second contact J2.

Each of differential channels comprises respective electrical components. The first differential channel comprises a first transformer 213 defining a primary coil 213*a* and a secondary coil 213*b*, and a first common mode choke coil 215 defining a first coil 215*a* and a second coil 215*b*. The first primary coil 213*a* has two connecting ends and a center tap connected to the first side 101, respectively. The secondary coil 213*b* has two connecting ends and a center tap 213*c* connected to a resistor 15. One end of the first coil 215*a* and one end of the second coil 215*b* respectively connect to two connecting ends of the secondary coil 213*b* of the transformer 213. The other end of the first coil 215*a* and the other end of second coil 215*b* respectively connect to the first contact J1 and the second contact J2. The structure of the fourth differential channel 24 is same as that of the first differential channel 21.

The second differential channel 22 comprises a second transformer 223 defining a primary coil 223*a* and a secondary coil 223*b*, and a second common mode choke coil 225 defining a first coil 225*a* and a second coil 225*b*. The primary coil 223*a* has two connecting ends and a center tap connected to the first side 101, respectively. The secondary coil 223*b* has two connecting ends and a center tap 223*c* connected to another resistor 15. One end of the first coil 225*a* and one end of the second coil 225*b* respectively connect to two connecting ends of the secondary coil 223*b* of the transformer 223. The other end of the first coil 225*a* and the other end of second coil 225*b* respectively connect to the third contact J3 and the sixth contact J6. A capacitor 220 is connected between the second differential positive trace 22*a* and the second differential negative trace 22*c* of the second differential channel 22 to make the impedance of the second differential channel 22 match the impedance of the first differential channel 21.

The third differential channel 23 comprises a third transformer 233 defining a primary coil 233*a* and a secondary coil 233*b*, and a third common mold chock coil 235 defining a first coil 235*a* and a second coil 235*b*. The primary 233*a* has two connecting ends and a center tap connected to the first side 101, respectively. The secondary coil 233*b* has two connecting ends and a center tap 233*c* connected to the third resistor 15. All resistors 15 are in parallel and then in series connected to a end of a capacitor 16. The other end of the capacitor 16 is grounding. One end of the first coil 235*a* and one end of the second coil 235*b* respectively connect to two connecting ends of the secondary coil 233*b* of the transformer 233. The other end of the first coil 235*a* and the other end of second coil 235*b* respectively connect to the fourth contact J4 and the fifth contact J5. A capacitor 221 is connected between the second coil 235*b* of the third common mold chock coil 235 and the first coil 225*a* of the second common mold chock coil 225. Another capacitor 224 is connected between the first coil 235*a* of the third common mold chock coil 235 and the second coil 225*b* of the second common mold chock coil 225.

Figure 3:
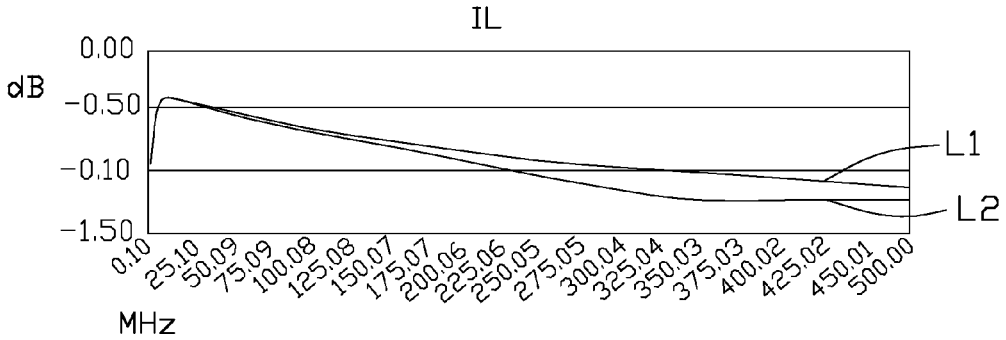
FIG. 3 is a diagram of an insertion loss in an electrical testing of the circuit as shown in FIG. 2.
Figure 4:
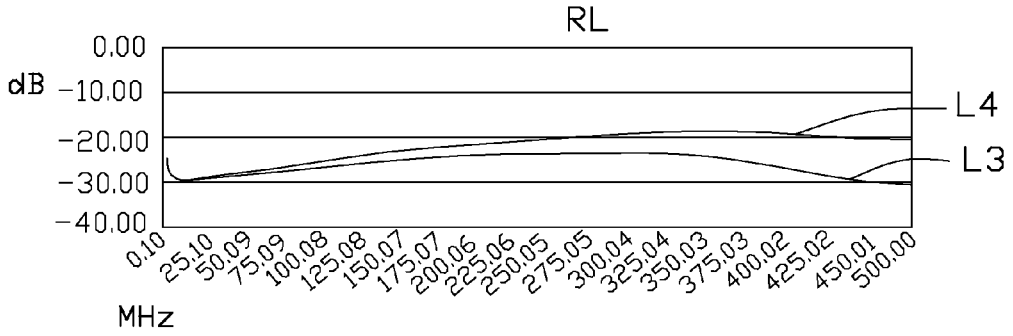
FIG. 4 is a diagram of a return loss in an electrical testing of the circuit of as shown in FIG. 2.

FIG. 3 is an electrical test pattern about insertion loss (IL) of the second differential channel 22, and FIG. 4 is an electrical test pattern about return loss (RL) of the second differential channel 22. There is an abscissa referring to a frequency value which is presence in the second differential channel 22 and an ordinate referring to a value about insertion loss or return loss In FIG. 3 or FIG. 4.

Line L1 is a value about insertion loss when the capacitor 220 is added between the second positive differential trace 22*a* and the second negative differential trace 22*c*, and Line L2 is a value about insertion loss when no capacitor is added between the second positive differential trace 22*a* and the second negative differential trace 22*c*. Line L3 is a value about return loss when the capacitor 220 is added between the second positive differential trace 22*a* and the second negative differential trace 22*c*, and Line L4 is a value about return loss when no capacitor is added between the second positive differential trace 22*a* and the second negative differential trace 22*c*.

With the frequency value in the range of 25.10 MHZ to 500.00 MHZ, the value about insertion loss when the capacitor 220 is added between the second positive differential trace 22*a* and the second negative differential trace 22*c* is higher than the value about insertion loss when no capacitor between the second positive differential trace 22*a* and the second negative differential trace 22*c* in view of FIG. 3, and the value about return loss when the capacitor 220 is added between the second positive differential trace 22*a* and the second negative differential trace 22*c* is lower than the value about return loss when no capacitor between the second positive differential trace 22*a* and the second negative differential trace 22*c* in view of FIG. 4. So, the insertion and return loss have been improved when the capacitor 220 is added between the second positive differential trace 22*a* and the second negative differential trace 22*c*. In system testing, the improved impedance is to solve effectively the problem of signal transmission easy to loss.

It is to be understood, however, that even though numerous characteristics of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector having:

a circuit comprising:

a first side;

a second side;

a first differential channel located between the first side and the second side and comprising a first positive differential trace and a first negative differential trace for transmitting a first differential signal; and a second differential channel located between the first side and the second side comprising a second positive differential trace and a second negative differential trace for transmitting a second differential signal; and a plurality of mating contacts connected to the second side and numbered from one to eight in sequence along a transverse direction, thus comprising a first contact connected to the first positive differential trace, a second contact connected to the first negative differential trace, a third contact connected to the second positive differential trace, and a sixth contact connected to the second negative differential trace, the first contact, the second contact, the third second, and the sixth contact are arranged one by one; wherein a distance between the third contact and the sixth contact is greater than a distance between the first contact and the second contact; wherein a capacitor is connected between the second positive differential trace and the second negative differential trace to make an impedance of the second differential channel match with an impedance of the first differential channel.

2. The electrical connector as recited in claim 1, wherein the electrical connector further comprises a third differential channel located between the first side and the second side comprising a third positive differential trace connected to a fourth contact of the mating contacts and a third negative differential trace for transmitting third differential signal connected to a fifth contact of the mating contacts.

3. The electrical connector as recited in claim 2, wherein the fourth and the fifth contacts are located between the third contact and the sixth contact.

4. The electrical connector as recited in claim 3, wherein the fourth contact is near to the third contact, and the fifth contact is near to the sixth contact.

5. The electrical connector as recited in claim 2, wherein all the differential channels have a transformer and a common mode choke coil connected the transformer to the second side, respectively.

6. The electrical connector as recited in claim 5, wherein the transformer has a primary coil and a secondary coil corresponding to the primary coil.

7. The electrical connector as recited in claim 6, wherein the common mode choke coil has a first coil and a second coil corresponding to the first coil.

8. The electrical connector as recited in claim 7, wherein the primary coil has two connecting ends and a center tap connected to the first side, and the secondary coil has two connecting ends connected respectively to one end of the first coil and one end of the second coil of the common mode choke coil in the same differential channel.

9. The electrical connector as recited in claim 7, wherein both the other end of the first coil and the other end of second coil respectively connect to one corresponding mating contact.

10. The electrical connector as recited in claim 7, wherein the secondary coil of each differential channel further has a center tap connected respectively to a resistor, and all the resistor are in parallel and then in series connected to a capacitor which is grounding.

11. The electrical connector as recited in claim 7, wherein a capacitor is connected between the first coil of the second differential channel which is connected to the third contact and the second coil of the third differential channel which is connected to the fifth contact.

12. The electrical connector as recited in claim 11, wherein a capacitor is connected between the second coil of the second differential channel which is connected to the sixth contact and the first coil of the third differential channel which is connected to the fourth contact.

13. The electrical connector as recited in claim 2, wherein the electrical connector further comprises a fourth differential channel being same as the first differential channel to connect to a seventh contact and an eighth contact of the mating contacts.

14. The electrical connector as recited in claim 1, wherein the electrical connector is a RJ45 type connector.

15. An electrical connector assembly comprising:

an insulative housing;

a plurality of contacts disposed in the housing each extending along a front-to-back direction, the plurality of contacts being numbered from one to eight in sequence along a transverse direction perpendicular to said front-to-back direction, wherein a first and a second contacts are arranged as a first differential pair, a third and a sixth contacts are arranged as a second differential pair, a fourth and a fifth contacts are arranged as a third differential pair, and a seventh and an eighth contacts are arranged as a fourth differential pair;

a printed circuit board defining thereon, corresponding to said contacts in a relation of electrical connection, a plurality of circuit traces transversely spaced from one another relative to an extension direction of said circuit traces and numbered from one to eight corresponding to said contacts, wherein a first and a second circuit traces of the plurality of circuit traces are arranged as a first differential pair channel, a third and a sixth circuit traces of the plurality of circuit traces are arranged as a second differential pair channel, a fourth and a fifth circuit traces of the plurality of circuit traces are arranged as a third differential pair channel, and a seventh and an eighth circuit traces of the plurality of circuit traces are arranged as a fourth differential pair channel; wherein a capacitor is connected between the third circuit trace and the sixth circuit trace transversely relative to the extension direction of the circuit traces for having an impedance of the first differential pair channel match with that of the second differential pair channel.

16. An electrical connector assembly comprising:

an insulative housing;

a plurality of contacts disposed in the housing each extending along a front-to-back direction while all numbered from one to eight in sequence along a transverse direction perpendicular to said front-to-back direction, wherein a first and a second contacts are arranged as a first differential pair, a third and a sixth contacts are arranged as a second differential pair, a fourth and a fifth contacts are arranged as a third differential pair, and a seventh and an eighth contacts are arranged as a fourth differential pair;

a printed circuit board defining thereon, corresponding to said contacts in a relation of electrical connection, a plurality of circuit traces transversely spaced from one another relative to an extension direction of said circuit traces and numbered from one to eight corresponding to said contacts, wherein a first and a second circuit traces of the plurality of circuit traces are arranged as a first differential pair channel, a third and a sixth circuit traces of the plurality of circuit traces are arranged as a second differential pair channel, a fourth and a fifth circuit traces of the plurality of circuit traces are arranged as a third differential pair channel, and a seventh and an eighth circuit traces of the plurality of circuit traces are arranged as a fourth differential pair channel; and a first capacitor connected between the third circuit trace and the sixth circuit trace transversely relative to the extension direction of the circuit traces, and a second capacitor connected between the fourth circuit trace and the fifth circuit trace for having an impedance of the second differential pair channel match with that of the third differential pair channel.

* * * * *